United States Patent [19]

Bennett

[11] Patent Number: 4,553,684

[45] Date of Patent: Nov. 19, 1985

[54] ONE PIECE PRESS AND LOCK TAB FOR CONTAINERS

[76] Inventor: Robert A. Bennett, 170 Sturbridge Rd., Easton, Conn. 06612

[21] Appl. No.: 677,072

[22] Filed: Nov. 30, 1984

[51] Int. Cl.[4] ..... B65D 41/32

[52] U.S. Cl. ..... 220/268

[58] Field of Search ..... 220/266–270

[56] References Cited

U.S. PATENT DOCUMENTS 3,927,794 12/1975 Erdman ..... 220/268
4,128,186 12/1978 Gane ..... 220/268
4,350,260 9/1982 Prueher ..... 220/268
4,377,244 3/1983 Rossetti ..... 220/268

*Primary Examiner*—George T. Hall

[57] ABSTRACT

A thin flat disc has a coplanar member or tab disposed therein. The tab has a straight edge integral with the remainder of the disc which constitutes a portion of the tab periphery. The remaining portion of the periphery is scored and defines a border. A horizontally elongated bar is integral with the tab. The bar lies in an essentially vertical plane, extends upward from the disc for a short distance and is essentially parallel to the straight edge.

7 Claims, 7 Drawing Figures

FIG. 2
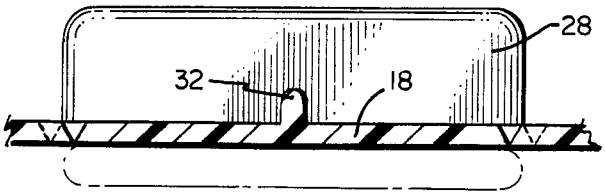
FIG. 1
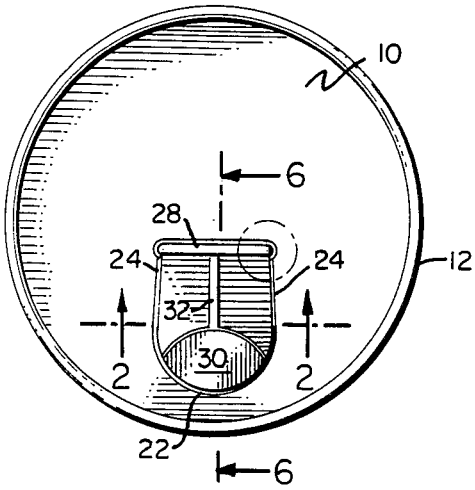
FIG. 3
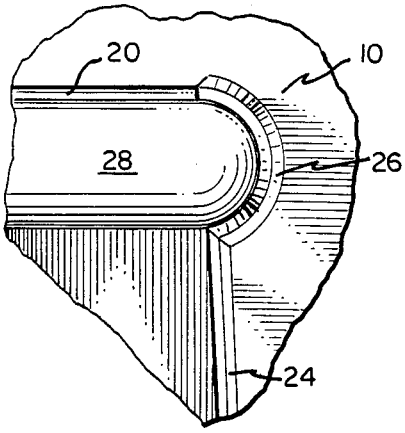
FIG. 4
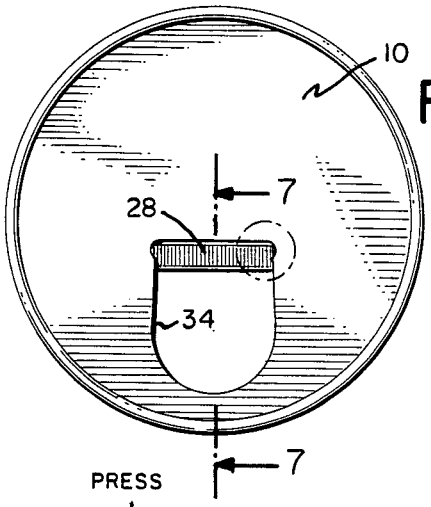
FIG. 5
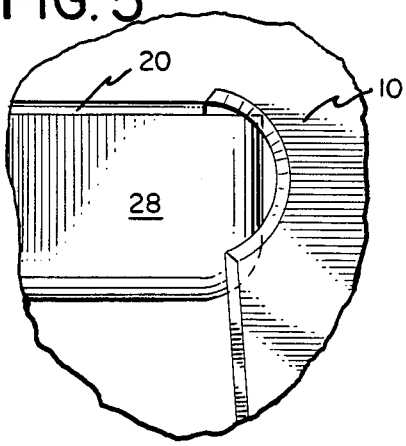
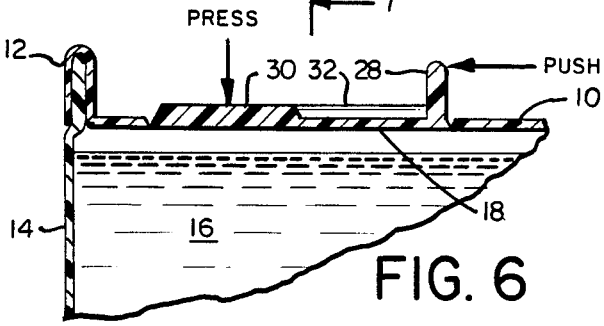
FIG. 6
FIG. 8
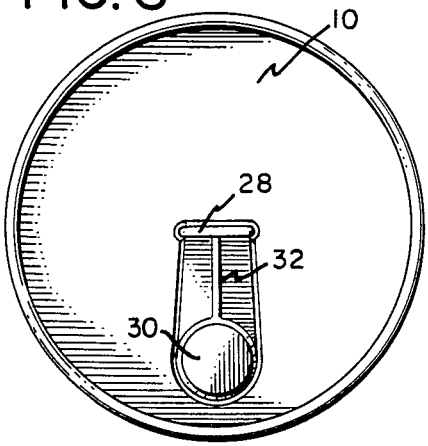
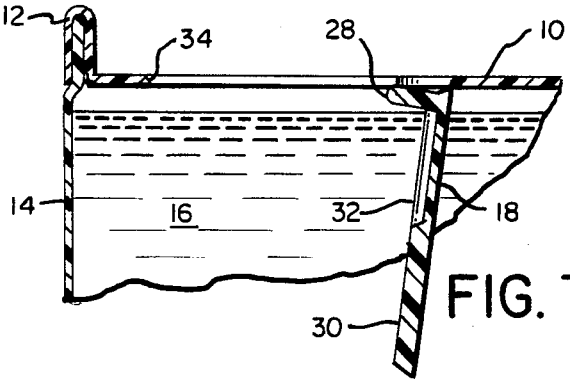
FIG. 7

ONE PIECE PRESS AND LOCK TAB FOR CONTAINERS

BACKGROUND OF THE INVENTION

Soda and other liquids conventionally are sold in cans having top mounted tabs which when manually operated by first being pulled and subsequently pushed dispose a section of the can itself in a downward position below the top of the can, thus forming an opening through which the soda or other liquid can be removed. Known tabs have three parts: a flat ring; a prescored section of the can; and a rivet interconnecting the ring and section.

The present invention is directed toward a new type of tab formed in one piece which is easily operated an enables the tab to be locked into open position. This new tab is easily and simply constructed at a much lower cost than known tabs.

SUMMARY OF THE INVENTION

In accordance with the principles of this invention, a disc adapted to be placed in sealing engagement with the open top of a container has a member disposed therein which is coplanar with the disc. This member constitutes a tab. It has, as a portion of its periphery, a straight edge integral with the remainder of the disc, the remaining portion of the periphery being scored and defining a border.

A straight horizontally elongated bar, which lies an essentially vertical plane and is essentially parallel to said straight edge, is integral with the tab and extends upward for a short distance. The bar, after the scoring portion is broken by manually pushing the portion of the tab remote from the bar, is adapted to itself being pushed into an essentially horizontal plane in a position adjacent but below the disc. This action moves the tab into a downwardly projecting position whereby an opening is formed in the disc.

The opening is spanned by the bar. The length of the bar is so adjusted relative to the opening that each end of the bar extends beyond the opening to underlie the disc and lock the bar in position whereby said tab is also locked in position.

The disc, tab and integral bar can be used to seal a can containing soda or the like whereby the one piece tab and bar can be used in the manner previously described.

BRIEF DESCRIPTION OF THE DRAWINGS

FIG. 1 is a top plan view of a disc incorporating a tab in closed position in accordance with the invention.

FIG. 2 is a view taken along line 2—2 in FIG. 1.

FIG. 3 is an enlarged view of that portion of the structure of FIG. 1 shown in a small dotted circle in FIG. 1.

FIG. 4 is a view similar to FIG. 1 but showing the tab in open position.

FIG. 5 is an enlarged view of that portion of the structure of FIG. 4 shown in a small dotted circle in FIG. 1.

FIG. 6 is a view taken along line 6—6 in FIG. 1.

FIG. 7 is a view taken along line 7—7 in FIG. 4.

FIG. 8 is a view similar to FIG. 1 but showing a slightly modified form of structure.

DETAILED DESCRIPTION OF PREFERRED EMBODIMENTS

Referring first to FIGS. 1, 2, 3 and 6, there is shown a flat circular disc 10 having a raised peripheral lip 12 which can be sealed to a top open peripheral edge of a hollow container 14 containing soda or other liquid 16. The disc has a member 18 therein which is coplanar with the disc and defines a tab. The tab has a straight edge 20 which is integral with the remainder of the disc and which is a portion of the periphery of the tab. The remaining portions of the periphery consisting of an inwardly curved section 22 connected by straight line portions 24 to small curved sections 26 to edge 20 are all scored.

A horizontally elongated straight bar 28 integral with the tab is adjacent edge 20. The opposite ends of the bar are somewhat curved whereby sections 26 extend there around. The bar lies in an essentially vertical plane (in the present example the included angle between bar and disc is 87 degrees) and extends upward for a short distance.

The tab has a generally circular raised region 30 remote from the bar and interconnected thereto by a transversely disposed raised strengthening rib 32. Region 30 and rib 32 are also integral with the disc.

Referring now to FIGS. 4, 5 and 7, after region 30 is manually pushed in to break the scoring, bar 28 can be manually pushed into an essentially horizontal position adjacent but below the disc. This action causes the tab to be swung almost vertically downward into the liquid, thus forming the desired opening 34. Bar 28 spans the opening with each end of the bar extending somewhat beyond the opening (the bar is longer than the portion of the opening spanned by the bar) whereby the bar is locked in position and the tab is also locked in position.

The disc and tab with integral rib, raised region and bar are all made of the same material as for example plastic or aluminum.

FIG. 8 shows a narrower longer modification of the structure shown in FIGS. 1–7. The structure of FIG. 8 is so narrow that a finger cannot fit into the opening whereby cuts caused by sharp edges cannot occur.

The bar 28 can be moved forwardly along the tab from a position adjacent the straight edge. The only effect will be to reduce the size of the included angle between the disc and the submerged tab.

What is claimed is:

1. A disc adapted to be placed in sealing engagement with the open top of a container and comprising:

a thin flat disc having a member disposed therein, said member being coplanar with the disc and constituting a tab, said tab having as a portion of its periphery a straight edge integral with the remainder of the disc, the remaining portion of said periphery being scored and defining a border; and a horizontally elongated straight bar lying in an essentially vertical plane and being essentially parallel to said edge, said bar being integral with said tab and extending upward for a short distance, said bar after said scoring is broken being adapted to be moved into an essentially horizontal plane in a position adjacent but below the disc with the tab projecting downwardly therefrom whereby an opening is formed in said disc, and is spanned by said bar, the length of said bar having such relation to said opening that each end of the bar extends beyond said opening to underlie the disc and lock the bar in said position whereby said tab is also locked in position.

2. The disc of claim 1 wherein said member is elongated, said straight edge defining one side of the member, said member having an opposite side being scored and inwardly curved, each end of the straight side being connected by a corresponding scored line to an adjacent end of the curved side.

3. The disc of claim 2 wherein said member has a raised flattened region having a generally circular periphery, a portion of said circular periphery being coincident with said curved side.

4. The disc of claim 1 wherein said bar is disposed adjacent said straight edge.

5. The disc of claim 1 wherein the included angle between said bar and said disc is slightly less than 90°.

6. The disc of claim 3 further including a straight horizontally elongated raised rib extending between said flattened region and said bar.

7. The disc of claim 6 wherein said disc has a raised peripheral lip adapted to be secured to the open top peripheral edge of said container.

* * * * *